US009773465B2

(12) United States Patent
Sohn et al.

(10) Patent No.: US 9,773,465 B2
(45) Date of Patent: Sep. 26, 2017

(54) DISPLAY APPARATUS AND METHOD OF DRIVING THE DISPLAY APPARATUS

(71) Applicant: Samsung Display Co., Ltd., Yongin (KR)

(72) Inventors: Young-Soo Sohn, Guri-si (KR); Ki-Tae Yoon, Seoul (KR); Won-Bok Lee, Seongnam-si (KR); Jae-Gwan Jeon, Incheon (KR); Akihiro Takegama, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 330 days.

(21) Appl. No.: 14/705,533

(22) Filed: May 6, 2015

(65) Prior Publication Data

US 2016/0071454 A1 Mar. 10, 2016

(30) Foreign Application Priority Data

Sep. 5, 2014 (KR) ..... 10-2014-0118875

(51) Int. Cl.
*G09G 3/36* (2006.01)

(52) U.S. Cl.
CPC ..... *G09G 3/3614* (2013.01); *G09G 2330/021* (2013.01); *G09G 2330/045* (2013.01)

(58) Field of Classification Search
CPC ..... G09G 3/3614; G09G 2330/021; G09G 2330/045
USPC ..... 345/211–212
See application file for complete search history.

(56) References Cited

U.S. PATENT DOCUMENTS

2013/0314450 A1 11/2013 Sohn et al.

FOREIGN PATENT DOCUMENTS

| | | |
|---|---|---|
| KR | 10-2009-0095912 | 9/2009 |
| KR | 10-2012-0116615 | 10/2012 |
| KR | 10-2013-0015354 | 2/2013 |
| KR | 10-2015-0000807 | 1/2015 |

*Primary Examiner* — Michael Pervan
(74) *Attorney, Agent, or Firm* — H.C. Park & Associates, PLC

(57) ABSTRACT

A display apparatus including a classifier configured to classify image data into preset data of an n-bits ("n" is a natural number), a toggle counter configured to count a number of toggles based on preset data of a present horizontal line and a previous horizontal line and to calculate a final toggle number using a weighted values corresponding to a swing width between data voltages of the present and previous horizontal lines, a determiner configured to determine a representative toggle number of a present frame based on a plurality of final toggle numbers of the present frame, compare the representative toggle number with a plurality of threshold values and determine a level of a power control signal based on a compared result.

20 Claims, 9 Drawing Sheets

DISPLAY APPARATUS AND METHOD OF DRIVING THE DISPLAY APPARATUS

CROSS-REFERENCE TO RELATED APPLICATION

This application claims priority from and the benefit of Korean Patent Application No. 10-2014-0118875, filed on Sep. 5, 2014, which is hereby incorporated by reference for all purposes as if fully set forth herein.

BACKGROUND

Field

Exemplary embodiments of the inventive concept relate to a display apparatus and a method of driving the display apparatus. More particularly, exemplary embodiments relate to a display apparatus for reducing power consumption and a method of driving the display apparatus.

Discussion of the Background

A liquid crystal display ("LCD") panel may include a thin film transistor ("TFT") substrate, an opposing substrate, and a liquid crystal ("LC") layer disposed between the two substrates. The TFT substrate may include a plurality of gate lines, a plurality of data lines crossing the gate lines, a plurality of TFTs connected to the gate lines and the data lines, and a plurality of pixel electrodes connected to the TFTs. A TFT may include a gate electrode extended from a gate line, a source electrode extended to a data line, and a drain electrode spaced apart from the source electrode.

The LCD apparatus is driven in an inversion mode in which a polarity of a data voltage is reversed at a frame unit or a pixel unit in order to prevent deterioration of the LC layer. A data driver circuit that outputs the data voltage to the data line increases power consumption by a swing width of the data voltage according to the inversion mode. A heating of the data driver circuit may occur by increasing power consumption and, thus, the data driver circuit may be damaged.

The above information disclosed in this Background section is only for enhancement of understanding of the background of the inventive concept, and, therefore, it may contain information that does not form the prior art that is already known in this country to a person of ordinary skill in the art.

SUMMARY

Exemplary embodiments of the inventive concept provide a display apparatus for reducing heating of a driver circuit.

Additional aspects will be set forth in the detailed description which follows, and, in part, will be apparent from the disclosure, or may be learned by practice of the inventive concept.

Exemplary embodiments of the inventive concept provide a method of driving the display apparatus.

An exemplary embodiment of the inventive concept discloses a display apparatus including a display panel including a data line and a gate line crossing the data line, a classifier configured to classify image data into preset data of an n-bits ("n" is a natural number), a toggle counter configured to count a number of toggles based on preset data of a present horizontal line and a previous horizontal line and to calculate a final toggle number using weighted values corresponding to a swing width between data voltages of the present horizontal line and previous horizontal line, a determiner configured to determine a representative toggle number of a present frame based on a plurality of final toggle numbers of the present frame, compare the representative toggle number with a plurality of threshold values, and determine a level of a power control signal based on a compared result and a data driver circuit configured to drive the data line, and control a power of an output signal based on the determined level of the power control signal.

An exemplary embodiment also discloses a method of driving a display apparatus. The method includes classifying image data into preset data of an n-bits ("n" is a natural number), counting a number of toggles based on preset data of a present horizontal line and a previous horizontal line, calculating a final toggle number using weighted values corresponding to a swing width between data voltages of the present horizontal line and previous horizontal line, determining a level of a power control signal comparing the representative toggle number of a present frame with a plurality of threshold values and controlling a power of an output signal of a data driver circuit configured to drive a data line of a display panel based on the determined level of the power control signal.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

DETAILED DESCRIPTION OF THE ILLUSTRATED EMBODIMENTS

Figure 1:
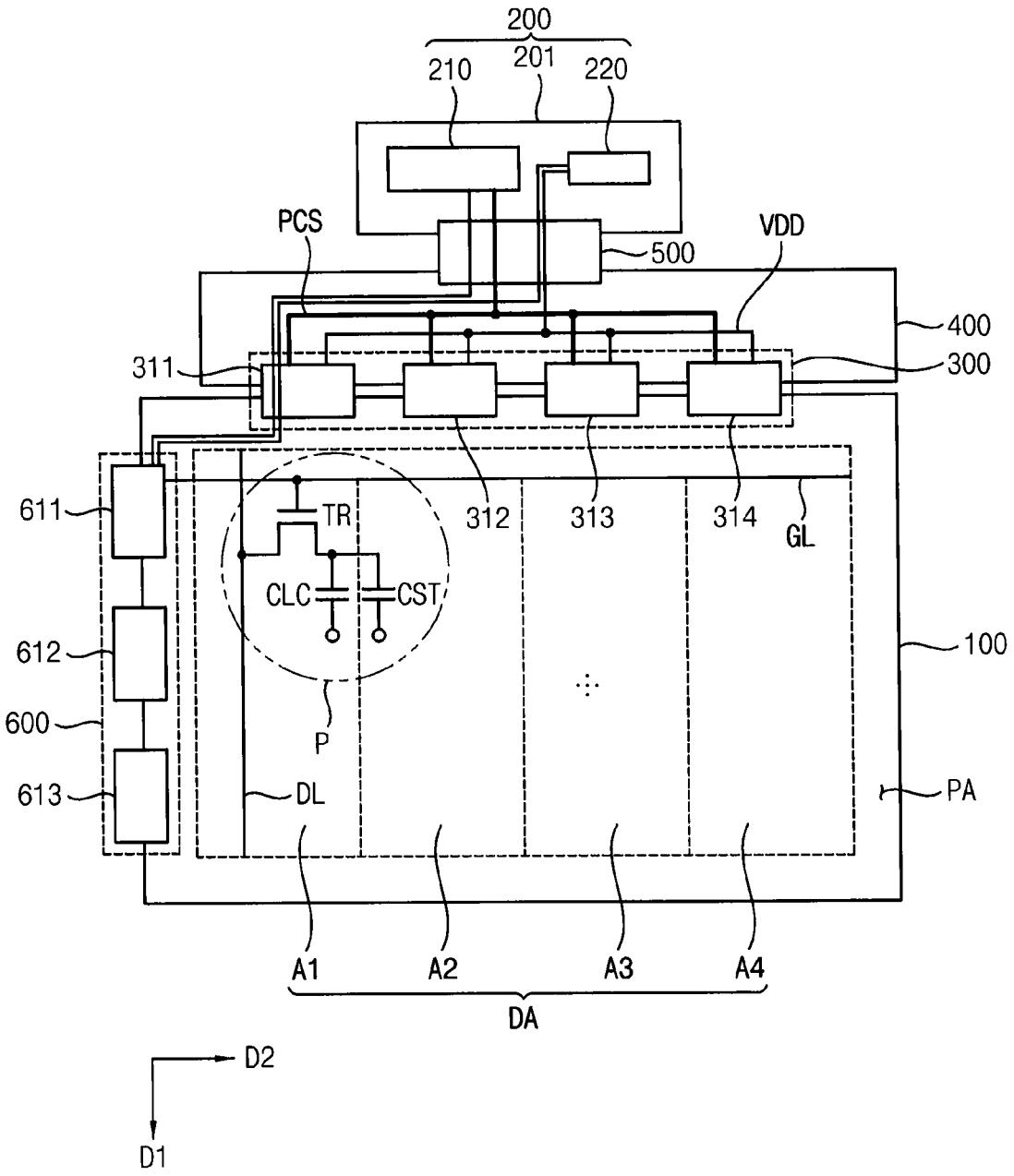
FIG. 1 is a block diagram illustrating a display apparatus according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a block diagram illustrating a display apparatus according to an exemplary embodiment.

Referring to FIG. 1, the display apparatus may include a display panel 100, a control circuit module 200, a data driver module 300, a source circuit board 400, a flexible circuit board 500, and a gate driver module 600.

The display panel 100 includes a display area DA and a peripheral area PA surrounding the display area DA.

The display panel 100 includes a plurality of data lines DL, a plurality of gate lines GL, and a plurality of pixels P which are disposed in the display area DA. The data lines DL extend in a first direction D1 and are arranged in a second direction D2 crossing the first direction D1. The gate lines GL extend in the second direction D2 and are arranged in the first direction D1.

The pixels P are arranged in a matrix including pixel columns and pixel rows. A pixel column includes a plurality of pixels arranged in the first direction D1. A pixel row includes a plurality of pixels arranged in the second direction D2. Each of the pixels P includes a transistor TR connected to a data line and a gate line, an LC capacitor CLC connected to the transistor TR, and a storage capacitor connected to the LC capacitor CLC. The LC capacitor CLC receives a common voltage VCOM, and the storage capacitor receives a storage voltage. The storage voltage may be equal to the common voltage VCOM.

The control circuit module 200 includes a timing controller 210 and voltage generator 220 that are disposed on a printed circuit board 201.

The timing controller 210 is configured to receive image data to compensate the image data using various compensation algorithms, and to provide the data driver module 300 with compensated image data. The various compensation algorithms may include an algorithm compensating an LC response time, an algorithm compensating a full white, and an algorithm compensating a gamma difference.

The controller 210 is configured to receive an original synch signal, and to generate a plurality of control signals for driving the display panel 100 based on the original synch signal. The control signals may include a data control signal for controlling the data driver module 300 and a gate control signal for controlling the gate driver module 600. The data control signal may include a horizontal synch signal, a vertical synch signal, a data enable signal, a polarity control signal, etc. The gate control signal may include a vertical start signal, a gate clock signal, an output enable signal, etc.

In an exemplary embodiment, the data control signal may include a power control signal PCS for controlling a driven heating of the data driver module 300. A level of the power control signal PCS may be determined by a grayscale change and a polarity change between the image data of a present horizontal line and the image data of a previous horizontal line based on the image data of a frame period. The power slew rate and the charge share time of the output signal that is outputted from the data driver module 300 may be adjusted based on the level of the power control signal PCS.

The voltage generator 220 is configured to generate a plurality of driving voltages for driving the display panel 100 using an input voltage. The plurality of driving voltages may include a data driver voltage VDD applied to the data driver module 300, a gate driver voltage applied to the gate driver module 600, and a common voltage VCOM applied to the display panel 100. The data driver voltage VDD may include an analog source voltage AVDD for generating a data voltage applied to the data line DL. The gate driver voltage may include a gate-on voltage and a gate-off voltage for generating a gate signal applied to the gate line GL.

The data driver module 300 may include a plurality of data driver circuits 311, 312, 313, and 314 as a Tape Carrier Package ("TCP") having a flexible film on which a driver chip is disposed. First end portions of the data driver circuits 311, 312, 313, and 314 are disposed in the peripheral area PA of the display panel 100. Each of the data driver circuits 311, 312, 313, and 314 is configured to convert the image data to the data voltage based on the data control signal and to output the data voltage to the data line DL.

Each of the data driver circuits 311, 312, 313, and 314 is configured to adjust the power slew rate and the charge share time of the data voltage applied to the data line DL based on the level of the power control signal PCS. Thus, the data driver circuits 311, 312, 313, and 314 may prevented from a driven heating.

The display area DA of the display panel 100 may be divided into a plurality of driving areas A1, A2, A3, and A4 respectively corresponding to the data driver circuits 311, 312, 313, and 314. For example, a data driver circuit 311 is configured to drive the data lines connected to pixels in a driving area A1.

Second end portions of the data driver circuits 311, 312, 313, and 314 are disposed on the source circuit board 400. The source circuit board 400 is connected to the flexible circuit board 500.

The flexible circuit board 500 connects the source circuit board 400 and the printed circuit board 201 of the circuit control module 200.

The gate driver module 600 may include a plurality of gate driver circuits 611, 612, and 613 as a TCP type having a flexible film on which a driver chip is disposed. The gate driver circuits 611, 612 and 613 are disposed in the peripheral area PA of the display panel 100. Alternatively, the gate driver module 600 may be a shift register that includes a plurality of transistors directly integrated in the peripheral area PA.

Each of the gate driver circuits 611, 612, and 613 is configured to generate a plurality of gate signals using the gate control signal and to sequentially output the gate signal to the gate line GL.

Figure 2:
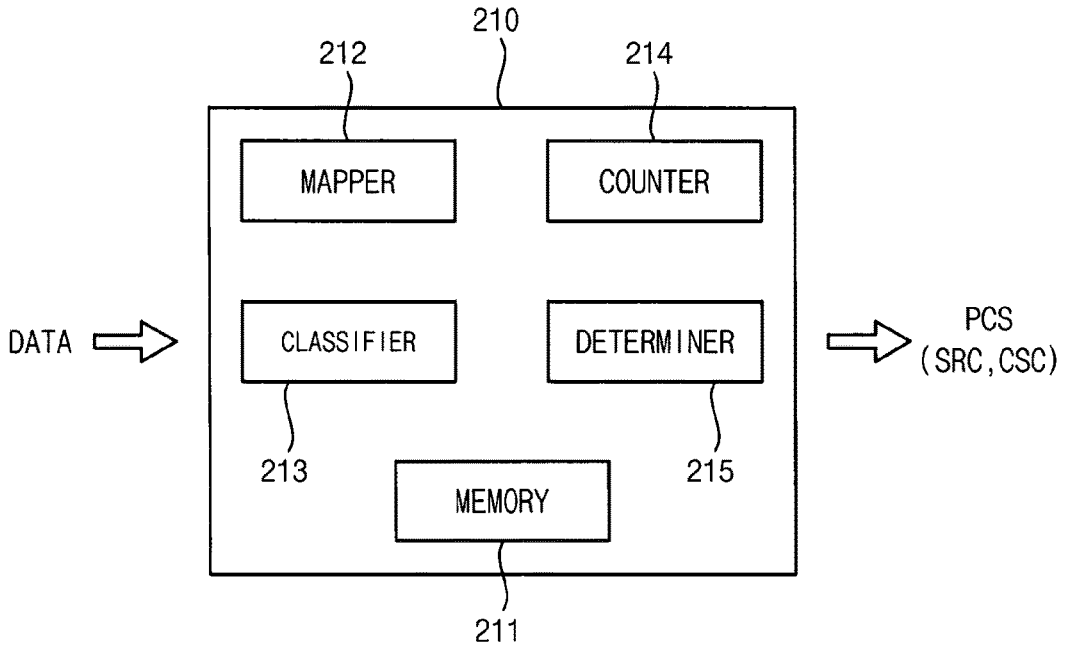
FIG. 2 is a block diagram illustrating a timing controller of FIG. 1.
Figure 3A:
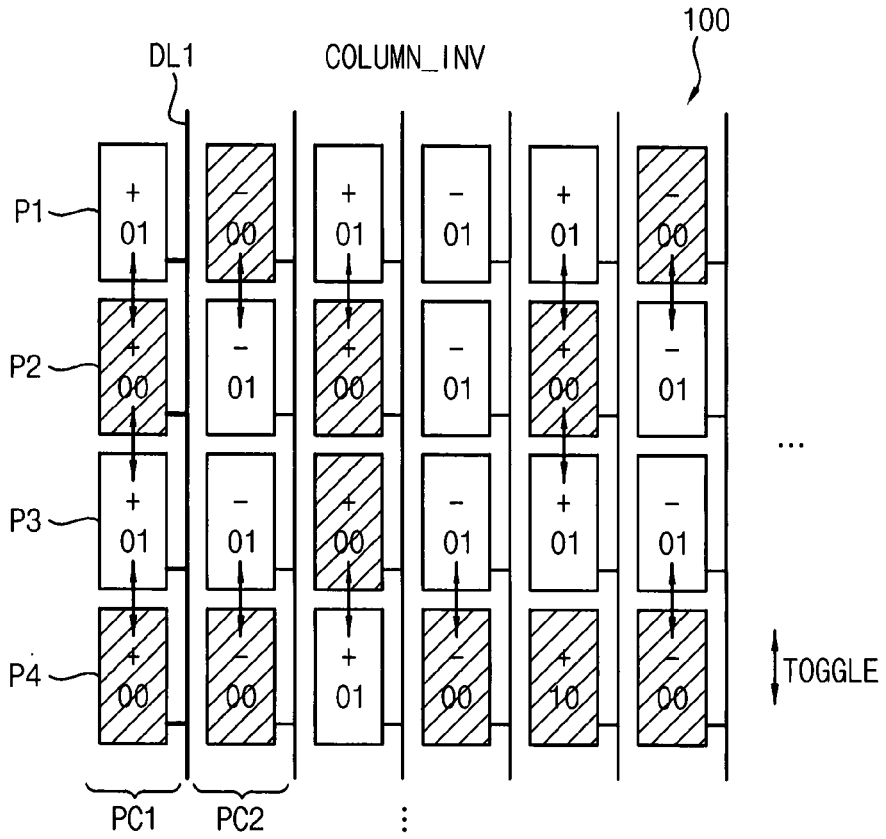
FIG. 3A and FIG. 3B are conceptual diagrams illustrating a method of driving the timing controller of FIG. 2.
Figure 3B:
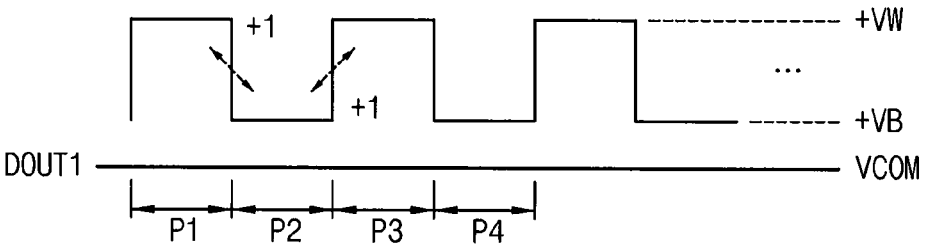

FIG. 2 is a block diagram illustrating a timing controller of FIG. 1. FIGS. 3A and 3B are conceptual diagrams illustrating a method of driving the timing controller of FIG. 2.

Referring to FIGS. 1 and 2, the timing controller 210 may include a memory 211, a mapper 212, a classifier 213, a counter 214, and a determiner 215.

The memory 211 is configured to store the image data DATA. The memory 211 may be a line memory storing the image data DATA by a horizontal line unit, such as a line memory.

The mapper 212 is configured to rearrange the image data DATA according to a pixel structure of the display panel 100.

The classifier 213 is configured to classify the image data DATA into a plurality of preset data having n-bits ("n" is a natural number).

For example, the classifier 213 classifies the image data DATA into the plurality of preset data having 2-bits. The image data DATA are classified into high preset data (01), low preset data (00), or normal preset data (10) based on a high reference grayscale and a low reference grayscale. When a grayscale of the image data DATA is greater than the high reference grayscale, the image data DATA are classified into the high preset data (01). When the grayscale of the image data DATA is equal to or less than the low reference grayscale, the image data DATA are classified into the low preset data (00). When the grayscale of the image data DATA is greater than the low reference grayscale and equal to or less than the high reference grayscale, the image data DATA are classified into the normal preset data (10).

The toggle counter 214 is configured to compare the preset data of the present horizontal line and the preset data of the previous horizontal line classified from the classifier 213. The toggle counter 214 is configured to count a number of toggles ("toggle number") in which the preset data applied to a same data line are changed from the high preset data (01) to the low preset data (00), or from the low preset data (00) to the high preset data (01). In addition, the toggle counter 214 is configured to apply a weighted value to the toggle number based on a swing width between polarities of data voltages of the present and previous horizontal lines applied to the same data line in the inversion mode of the display panel 100.

Referring to FIGS. 3A and 3B, the inversion mode of the display panel may be referred to as a column inversion mode, and the pixel structure of the display panel may be referred to as a non-alternating connection structure. According to the column inversion mode, the polarity of the data voltage is reversed by a pixel column period. According to the non-alternating connection structure, pixels in a same pixel column are connected to the same data line.

As shown in FIG. 3A, a first pixel P1, a second pixel P2, a third pixel P3, and a fourth pixel P4 in a first pixel column PC1 are connected to a first data line DL. The first, second, third, and fourth pixels P1, P2, P3, and P4 in the first pixel column PC1 have a first polarity (+) and pixels in a second pixel column PC2 adjacent to the first pixel column PC1 have a second polarity (−) opposite the first polarity (+).

For example, the image data of the first pixel P1 are classified into the high preset data (01), the image data of the second pixel P2 are classified into the low preset data (00), the image data of the third pixel P3 are classified into the high preset data (01), and the image data of fourth pixel P4 are classified into the low preset data (00), by the classifier 213.

The toggle counter 214 counts the toggle number based on the preset data (01, 00, 10, 00) of the pixels in the first pixel column PC1. The toggle number based on the first, second, third, and fourth pixels P1, P2, P3, and P4 is three according to a preset data change (01→00) of the first and second pixels P1 and P2, a preset data change (00→01) of the second and third pixels P2 and P3 and a preset data change (01→00) of the third and fourth pixels P3 and P4.

As described above, the toggle counter 214 counts and sums up the number of toggles respectively corresponding to a plurality of driving areas A1, A2, A3, and A4 driven by the data driver circuits.

In addition, the toggle counter 214 applies a weighted value to the toggle number based on a swing width between polarities of data voltages of the present and previous horizontal lines applied to the same data line in the column inversion mode of the display panel 100.

Referring to FIG. 3B, pixels P1, P2, P3, P4, . . . in the first pixel column PC1 receive a data voltage DOUT1 through the first data line DL1. The data voltage DOUT1 applied to the pixels P1, P2, P3, P4, . . . in the first pixel column PC1 has a first polarity (+) based on the column inversion mode. As shown in FIG. 3B, when the first pixel P1 has a white grayscale, the second pixel P2 has a black grayscale, the third pixel P3 has the white grayscale, and the fourth pixel P4 has the black grayscale, the data voltage DOUT1 of the first data line DL1 swings between a white voltage +VW of the first pixel P1, a black voltage +VB of the second pixel P2, the white voltage +VW of the third pixel P3, and the black voltage +VB of the fourth pixel P4.

For example, a weighted value may be determined to be a first weighted value (+1) corresponding to a first swing width between the white voltage and the black voltage having the same polarity. Although not shown in the FIGS., a weighted value may be determined to be a second weighted value (+2) corresponding to a second swing width between the white voltage and the black voltage having a different polarity from each other, and a weighted value may be determined to be a third weighted value (0) corresponding to a third swing width between the black voltages having a different polarity from each other. In addition, a weighted value may be determined to be the first weighted value (+1) corresponding to the first swing width between the black voltage and the white black voltage having a different polarity from each other. Thus, when the swing width is increased, the weighted value is increased.

As described above, the toggle counter 214 sums up the toggle number of the preset data by the frame period, and applies the weighted value corresponding to the swing width of the data voltage to the toggle number of the frame period, such that a final toggle number is calculated. The final toggle number may be calculated respectively corresponding to the driving areas A1, A2, A3, and A4 driven by the data driver circuits.

The determiner 215 is configured to determine a representative toggle number of the present frame. For example, the determiner 215 may determine a maximum value of the final toggle numbers respectively corresponding to the driving areas A1, A2, A3, and A4 into the representative toggle number. Alternatively, the determiner 215 may determine a sum value of the final toggle numbers respectively corresponding to the driving areas A1, A2, A3, and A4 into the representative toggle number.

The determiner 215 is configured to compare the representative toggle number of the present frame with the representative toggle number of the previous frame and to determine a plurality of threshold values TH1, TH2, and TH3 as following table 1. The level of the power control signal PCS for controlling the power of the data driver circuits may be determined using the threshold values TH1, TH2, and TH3.

TABLE 1

| | Toggle Count Number | |
|---|---|---|
| | (N − 1) − th <= N − th | (N − 1) − th > N − th |
| TH1 | a1 | a2 |
| TH2 | b1 | b2 |
| TH3 | c1 | c2 |

Referring to Table 1, when the representative toggle number of the present frame N-th is equal to or greater than the representative toggle number of the previous frame (N−1)-th, a first threshold value TH1 is determined to be "a1", a second threshold value TH2 is determined to be "b1", and a third threshold value TH3 is determined to be "c1".

When the representative toggle number of the present frame N-th is less than the representative toggle number of the previous frame (N−1)-th, a first threshold value TH1 is determined to be "a2", a second threshold value TH2 is determined to be "b2", and a third threshold value TH3 is determined to be "c2".

The determiner 215 is configured to compare the threshold values TH1, TH2, and TH3 with the representative toggle number of the present frame, and to determine the level of the power control signal PCS based on the compared result.

For example, when the representative toggle number of the present frame N-th is less than the representative toggle number of a previous frame (N−1)-th, the determiner 215 determines "a2" as the first threshold value TH1, "b2" as the second threshold value TH2, and "c2" as the third threshold value TH3.

When the representative toggle number of the present frame is greater than the first threshold value (TH1=a2), the determiner 215 determines the level of the power control signal into a fourth level "3" that is a maximum level. When the representative toggle number of the present frame is less than the first threshold value (TH1=a2) and greater than the second threshold value (TH2=b2), the determiner 215 determines the level of the power control signal into a third level "2" that is less than the fourth level "3". When the representative toggle number of the present frame is less than the second threshold value (TH2=b2) and greater than the third threshold value (TH3=c2), the determiner 215 determines the level of the power control signal into a second level "1" that is less than the third level "2". When the representative toggle number of the present frame is less than the third threshold value (TH3=c2), the determiner 215 determines the level of the power control signal into a first level "0" that is less than the second level "1".

The determiner 215 is configured to provide the data driver circuits with the power control signal PCS. The power control signal PCS may include a slew control signal SRC for controlling the power slew rate of the output signal and a charge control signal CSC for controlling a charge share time of the output signal.

The determiner 215 is configured to provide the data driver circuits with the slew control signal SRC and the charge control signal CSC. The plurality of data driver circuits is configured to control the power slew rate and the charge share time of the output signal based on the slew control signal SRC and the charge control signal CSC, which have been determined by the determiner 215.

Figure 4A:
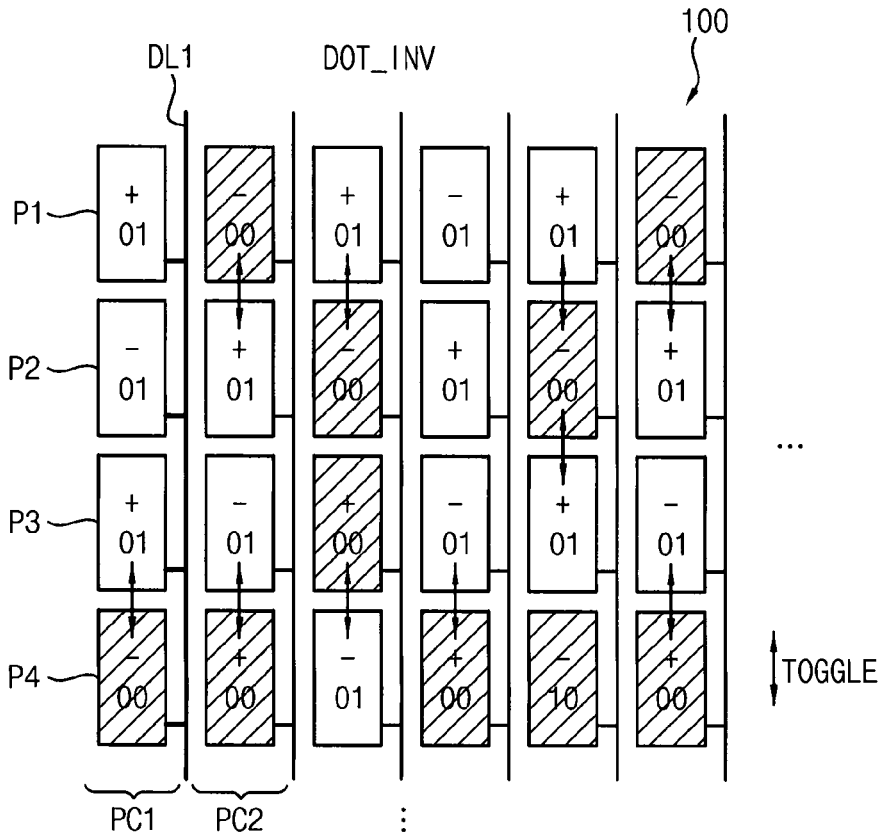
FIG. 4A and FIG. 4B are conceptual diagrams illustrating a method of driving a timing controller according to an exemplary embodiment.
Figure 4B:
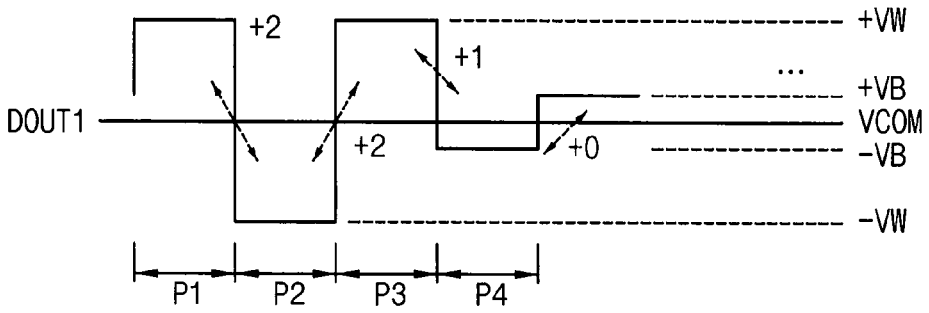

FIGS. 4A and 4B are conceptual diagrams illustrating a method of driving a timing controller according to an exemplary embodiment.

Referring to FIGS. 2, 4A, and 4B, the display panel 100 has a non-alternating connection structure and is driven in a dot inversion mode.

The memory 211 is configured to store the image data DATA. The memory 211 may be a line memory storing the image data DATA by a horizontal line period.

The mapper 212 is configured to rearrange the image data DATA according to a pixel structure of the display panel 100.

For example, the classifier 213 classifies the image data DATA into the preset data of 2-bits. The image data DATA are classified into high preset data (01), low preset data (00), or normal preset data (10) based on a high reference grayscale and a low reference. When a grayscale of the image data DATA is greater than the high reference grayscale, the image data DATA are classified into the high preset data (01). When the grayscale of the image data DATA is equal to or less than the low reference grayscale, the image data DATA are classified into the low preset data (00). When the grayscale of the image data DATA is greater than the low reference grayscale and equal to or less than the high reference grayscale, the image data DATA are classified into the normal preset data (10).

The toggle counter 214 is configured to compare the preset data of the present horizontal line and the preset data of the previous horizontal line classified from the classifier 213. The toggle counter 214 is configured to count a number of toggles in which the preset data applied to a same data line are changed from the high preset data (01) to the low preset data (00), or from the low preset data (00) to the high preset data (01). In addition, the toggle counter 214 is configured to apply a weighted value to the toggle number based on a swing width between polarities of data voltages of the present and previous horizontal lines applied to the same data line in the inversion mode of the display panel 100.

As shown in FIG. 4A, a first pixel P1, a second pixel P2, a third pixel P3, and a fourth pixel P4 in a first pixel column PC1 are connected to a first data line DL. The first, second, third, and fourth pixels P1, P2, P3, and P4 in the first pixel column PC1 alternately have a first polarity (+) and a second polarity (−) opposite the first polarity (+) according to the dot inversion mode.

For example, the image data of the first pixel P1 are classified into the high preset data (01), the image data of the second pixel P2 are classified into the low preset data (01), the image data of the third pixel P3 are classified into the high preset data (01), and the image data of fourth pixel P4 are classified into the low preset data (00), by the classifier 213.

The toggle counter 214 counts the number of toggles based on the preset data (01, 01, 01, 00) of the pixels in the first pixel column PC1. The toggle number based on the first, second, third, and fourth pixels P1, P2, P3 and P4 is one according to a preset data change (01→00) of the third, and fourth pixels P3 and P4.

As described above, the toggle counter 214 counts and sums up toggle numbers respectively corresponding to a plurality of driving areas driven by the data driver circuits.

In addition, the toggle counter 214 applies a weighted value to the toggle number based on a swing width between polarities of data voltages of the present and previous horizontal lines applied to the same data line in a dot inversion mode of the display panel 100.

Referring to FIG. 4B, pixels P1, P2, P3, P4, . . . in the first pixel column PC1 receive a data voltage DOUT1 through the first data line DL1. The data voltage DOUT1 applied to the pixels P1, P2, P3, P4, . . . in the first pixel column PC1 alternately has a first polarity (+) and a second polarity (−) based on the dot inversion mode. As shown in FIG. 4B, when the first pixel P1 has a white grayscale of the first polarity (+), the second pixel P2 has the white grayscale of the second polarity (−), the third pixel P3 has the white grayscale of the first polarity (+), and the fourth pixel P4 has the black grayscale of the second polarity (−), the data voltage DOUT1 of the first data line DL1 swings between a white voltage +VW of the first pixel P1, a white voltage −VW of the second pixel P2, the white voltage +VW of the third pixel P3 and a black voltage −VB of the fourth pixel P4.

The data voltage DOUT1 has the second swing width being the largest between the first and second pixels P1 and P2 and between the second and third pixels P2 and P3, between which the white voltages +VW and −VW have a different polarity from each other. Thus, the second weighted value +2 being the largest may be applied.

In addition, the data voltage DOUT1 of the third and fourth pixels P3 and P4 swings between the white voltage +VW of the first polarity (+) and the black voltage −VB of the second polarity (−) with a first swing width less than the second swing width and, thus, a weighted value between the third and fourth pixels P3 and P4 may be determined as a first weighted value +1 less than the second weighted value +2.

As described above, the toggle counter 214 sums up the toggle numbers of the preset data by the frame period, and applies the weighted value corresponding to the swing width of the data voltage to a sum of the toggle numbers, such that a final toggle number is calculated. The final toggle number may be calculated respectively corresponding to the driving areas A1, A2, A3 and A4 driven by the data driver circuits.

The determiner 215 determines a representative toggle number of the present frame. The determiner 215 compares the representative toggle number of the present frame with a representative toggle number of a previous frame, determines a plurality of threshold values TH1, TH2, and TH3 based on a comparison result, and determines a level of a power control signal PCS using the threshold values TH1, TH2, and TH3.

Figure 5A:
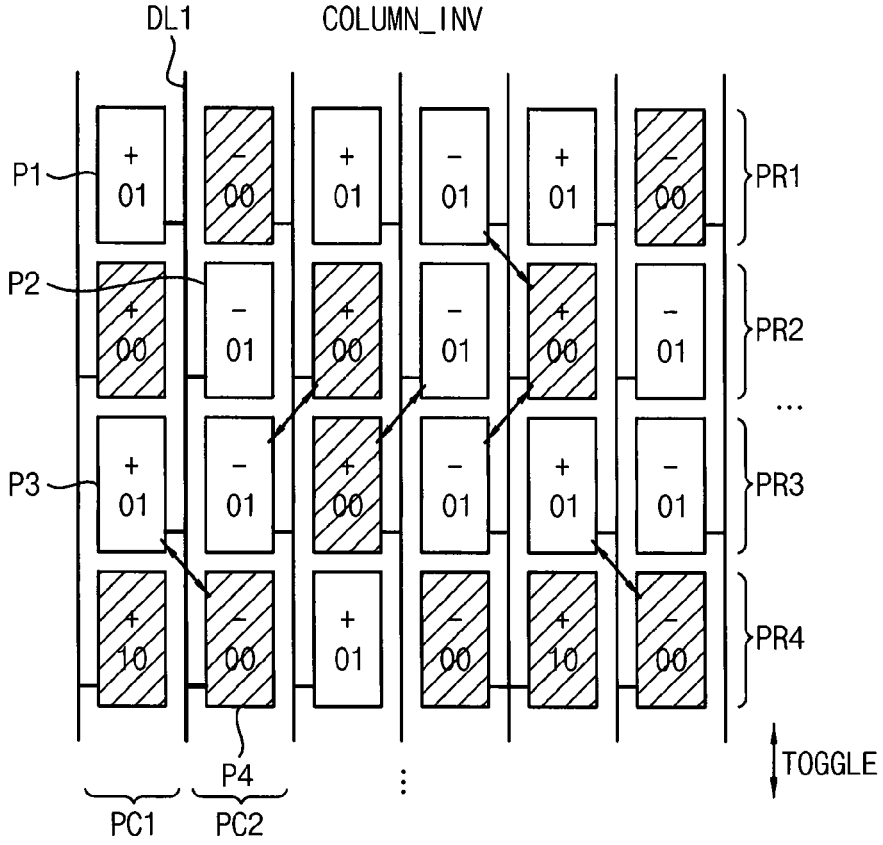
FIG. 5A and FIG. 5B are conceptual diagrams illustrating a method of driving a timing controller according to an exemplary embodiment.
Figure 5B:
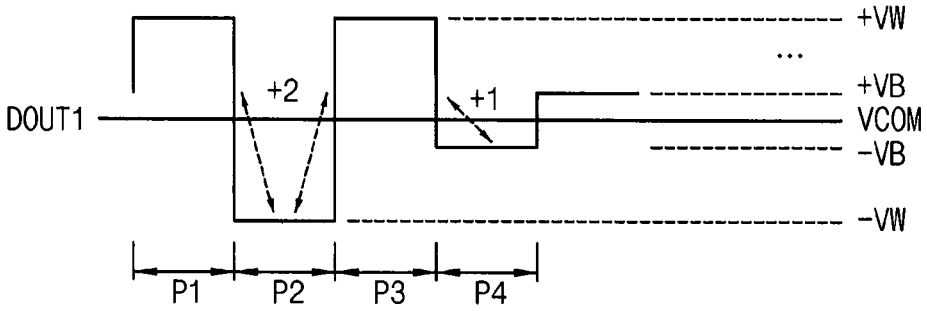

FIGS. 5A and 5B are conceptual diagrams illustrating a method of driving a timing controller according to an exemplary embodiment.

Referring to FIGS. 2, 5A and 5B, the display panel has an alternating connection structure and is driven with a column inversion mode.

The memory 211 is configured to store image data DATA by a horizontal line unit.

The mapper 212 is configured to rearrange the image data DATA according to a pixel structure of the display panel 100.

The classifier 213 is configured to classify the image data DATA into preset data of 2-bits. When a grayscale of the image data DATA is greater than the high reference grayscale, the image data DATA are classified into the high preset data (01). When the grayscale of the image data DATA is equal to or less than the low reference grayscale, the image data DATA are classified into the low preset data (00). When the grayscale of the image data DATA is greater than the low reference grayscale and equal to or less than the high reference grayscale, the image data DATA are classified into the normal preset data (10).

The toggle counter 214 is configured to count a number of toggles in which the preset data applied to a same data line are changed from the high preset data (01) to the low preset data (00) or from the low preset data (00) to the high preset data (01). In addition, the toggle counter 214 is configured to apply a weighted value to the toggle number based on a swing width between polarities of data voltages of the present and previous horizontal lines applied to the same data line in the inversion mode of the display panel 100.

As shown in FIG. 5A, the first data line DL1 is alternately connected to a first pixel P1, a second pixel P2, a third pixel P3, and a fourth pixel P4 in the first and second pixel columns PC1 and PC2. For example, the first data line DL1 is connected to the first pixel P1 in the first pixel column PC1, the second pixel P2 in the second pixel column PC2, the third pixel P3 in the first pixel column PC1, and the fourth pixel P4 in the second pixel column PC2. The first pixel P1 is included in a first pixel row PR1, the second pixel P2 is included in a second pixel row PR2, the third pixel P3 is included in a third pixel row PR3, and the fourth pixel P4 is included in a fourth pixel row PR4.

According to the alternating connection structure and the column inversion mode, the first, second, third, and fourth pixels P1, P2, P3, and P4 connected to the first data line DL1 alternately have a first polarity (+) and a second polarity (−).

As shown in FIG. 5A, for example, the image data of the first pixel P1 are classified into the high preset data (01), the image data of the second pixel P2 are classified into the high preset data (01), the image data of third pixel P3 are classified into the high preset data (01), and the image data of the fourth pixel P4 are classified into the low preset data (00), by the classifier 213.

The toggle counter 214 counts the toggle numbers based on the preset data (01, 01, 01, 00) of the first, second, third and fourth pixels P1, P2, P3, P4, . . . connected to the first data line DL1. For example, referring to the first, second, third, and fourth pixels P1, P2, P3, and P4, the toggle number is one according to a preset data change (01→00) of the third and fourth pixels P3 and P4.

As described above, the toggle counter 214 counts and sums up the toggle number of the preset data respectively corresponding to the plurality of driving areas of the plurality of data driver circuits.

In addition, the toggle counter 214 applies a weighted value to the toggle number based on a swing width of data voltages applied to the same data line in the column inversion mode of the display panel 100.

Referring to FIG. 5B, pixels P1, P2, P3, P4, . . . in the first and second pixel columns PC1 and PC2 receive a data voltage DOUT1 through the first data line DL1. The data voltage DOUT1 applied to the pixels P1, P2, P3, P4, . . . in the first and second pixel columns PC1 and PC2 alternately has a first polarity (+) and a second polarity (−) based on the column inversion mode and the alternating connection structure. As shown in FIG. 5B, when the first pixel P1 has a white grayscale of the first polarity (+), the second pixel P2 has the white grayscale of the second polarity (−), the third pixel P3 has the white grayscale of the first polarity (+), and the fourth pixel P4 has the black grayscale of the second polarity (−), the data voltage DOUT1 of the first data line DL1 swings between a white voltage +VW of the first pixel P1, a white voltage −VW of the second pixel P2, the white voltage +VW of the third pixel P3, and a black voltage −VB of the fourth pixel P4.

The data voltage DOUT1 has the second swing width being largest between the first and second pixels P1 and P2 and between the second and third pixels P2 and P3. The data voltage DOUT1 between the first and second pixels P1 and P2 swings between the white voltages +VW and −VW have polarities different from each other. The data voltage DOUT1 between the second and third pixels P2 and P3 swings between the white voltages +VW and −VW have polarities different from each other. Thus, the second weighted value +2 being largest may be applied.

In addition, the data voltage DOUT1 of the third and fourth pixels P3 and P4 swings between the white voltage +VW of the first polarity (+) and the black voltage −VB of the second polarity (−) with a first swing width less than the second swing width. Thus, a weighted value between the third and fourth pixels P3 and P4 may be determined as a first weighted value +1 less than the second weighted value +2.

As described above, the toggle counter 214 sums up the toggle numbers of the preset data by the frame period and applies the weighted value corresponding to the swing width of the data voltage to a sum of the toggle numbers, such that a final toggle number is calculated. The final toggle number may be calculated respectively corresponding to the driving areas A1, A2, A3 and A4 driven by the data driver circuits.

The determiner 215 determines a representative toggle number of the present frame. The determiner 215 compares the representative toggle number of the present frame with a representative toggle number of a previous frame, determines a plurality of threshold values TH1, TH2 and TH3 based on a comparison result, and determines a level of a power control signal PCS using the plurality of threshold values TH1, TH2 and TH3.

Figure 6A:
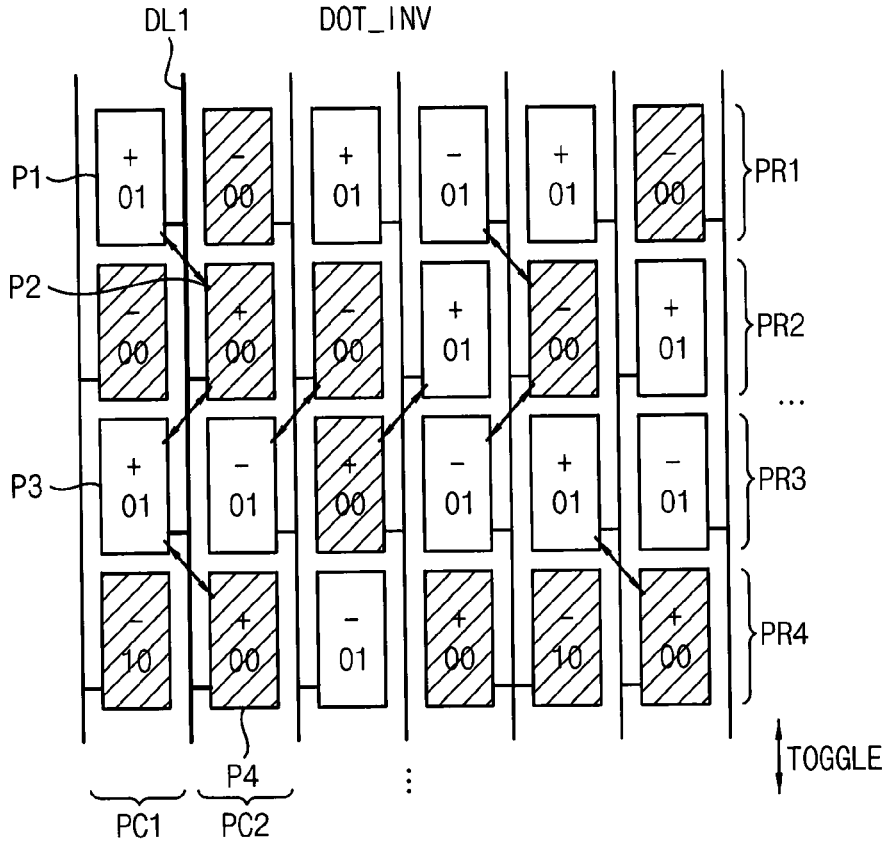
FIG. 6A and FIG. 6B are conceptual diagrams illustrating a method of driving a timing controller according to an exemplary embodiment.
Figure 6B:
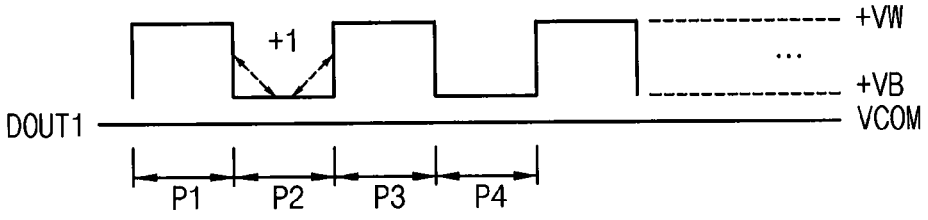

FIGS. 6A and 6B are conceptual diagrams illustrating a method of driving a timing controller according to an exemplary embodiment.

Referring to FIGS. 2, 6A, and 6B, the display panel has an alternating connection structure and is driven with a dot inversion mode.

The memory 211 is configured to store image data DATA by a horizontal line period.

The mapper 212 is configured to rearrange the image data DATA according to a pixel structure of the display panel 100.

The classifier 213 is configured to classify the image data DATA into preset data of 2-bits. When a grayscale of the image data DATA is greater than the high reference grayscale, the image data DATA are classified into the high preset data (01). When the grayscale of the image data DATA is equal to or less than the low reference grayscale, the image data DATA are classified into the low preset data (00). When the grayscale of the image data DATA is greater than the low reference grayscale and equal to or less than the high reference grayscale, the image data DATA are classified into the normal preset data (10).

The toggle counter 214 is configured to count a number of toggles in which the preset data applied to a same data line are changed from the high preset data (01) to the low preset data (00) or from the low preset data (00) to the high preset data (01). In addition, the toggle counter 214 is configured to apply a weighted value to the toggle number based on a swing width between polarities of data voltages of the present and previous horizontal lines applied to the same data line in the inversion mode of the display panel 100.

As shown in FIG. 6A, the first data line DL1 is alternately connected to a first pixel P1, a second pixel P2, a third pixel P3, and a fourth pixel P4 in the first and second pixel columns PC1 and PC2.

According to the alternating connection structure and the dot inversion mode, the first, second, third, and fourth pixels P1, P2, P3, and P4 have the same polarity, for example, the first polarity (+).

For example, by the classifier 213, the image data of the first pixel P1 are classified into the high preset data (01), the image data of the second pixel P2 are classified into the high preset data (01), the image data of third pixel P3 are classified into the high preset data (01), and the image data of the fourth pixel P4 are classified into the low preset data (00).

The toggle counter 214 counts the toggle number based on the preset data (01, 00, 01, 00) of the first, second, third and fourth pixels P1, P2, P3, P4, . . . connected to the first data line DL1. For example, referring to the first, second, third, and fourth pixels P1, P2, P3 and P4, the toggle number is three according to the preset data of the first and second pixels P1 and P2 changed such as (01→00), the preset data of the second and third pixels P2 and P3 changed such as (00→01) and the preset data of the third and fourth pixels P3 and P4 changed such as (01→00).

As described above, the toggle counter 214 is configured to count and sum up the toggle number of the preset data respectively corresponding to a plurality of driving areas driven by the plurality of data driver circuits.

In addition, the toggle counter 214 is configured to apply a weighted value to the toggle number based on a swing width of the data voltage applied to the same data line according to the dot inversion mode.

Referring to FIG. 6B, the pixels P1, P2, P3 and P4 in the first pixel column PC1 receive the data voltage DOUT1 through the first data line DL1. According to the dot inversion mode and the alternating connection structure, the data voltage DOUT1 has a first polarity (+). As shown in FIG. 6B, when the first pixel P1 has a white grayscale, the second pixel P2 has a black grayscale, the third pixel P3 has a white grayscale, and the fourth pixel P4 has a black grayscale, the data voltage DOUT1 applied to the first data line DL1 swings between a white voltage +VW of the first polarity (+) corresponding to the first pixel P1, a black voltage +VB of the first polarity (+) corresponding to the second pixel P2, a white voltage +VW of the first polarity (+) corresponding to the third pixel P, and a black voltage +VB of the first polarity (+) corresponding to the fourth pixel P4.

Thus, a weighted value between the first to fourth pixels P1, P2, P3, and P4 may be determined as a first weighted value +1.

As described above, the toggle counter 214 sums up the toggle numbers by a frame period, and then applies the weighted value corresponding to the swing width of the data voltage to the toggle number of the frame period, such that a final toggle number is calculated. The final toggle number may be calculated respectively corresponding to the driving areas A1, A2, A3, and A4 driven by the data driver circuits.

The determiner 215 is configured to determine a representative toggle number of the present frame. The determiner 215 is configured to compare the representative toggle number of the present frame with the representative toggle number of the previous frame and to determine a plurality of threshold values TH1, TH2 and TH3, and then the level of the power control signal PCS for controlling the power of the data driver circuits is determined using the threshold values TH1, TH2 and TH3.

Figure 7:
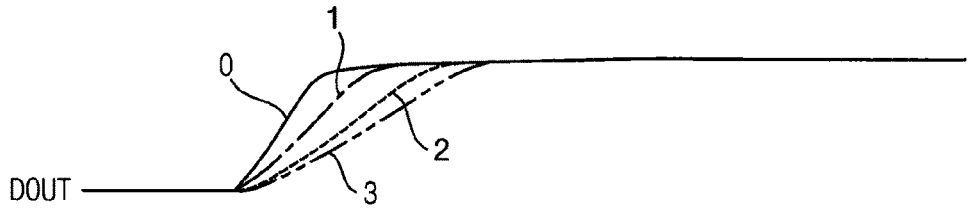
FIG. 7 is a waveform diagram illustrating a method of adjusting a power slew rate of an output signal which is outputted from a data driver circuit according to an exemplary embodiment.

FIG. 7 is a waveform diagram illustrating a method of adjusting a power slew rate of an output signal which is outputted from a data driver circuit according to an exemplary embodiment.

Referring to FIGS. 1 and 7, the data driver circuit is configured to receive a slew control signal being a power control signal PCS from the timing controller and to adjust a slew rate of an output signal DOUT of the data driver circuit based on the level of the slew control signal.

As shown in FIG. 7, when the level of the slew control signal has a fourth level "3" being the largest, the slew rate of the output signal DOUT is the largest. The slew rate is a rate at which an electronic amplifier can response to an abrupt change of input level. However, when the level of the slew control signal has a first level "0" being the smallest, the slew rate of the output signal DOUT is the smallest.

Therefore, the power slew rate of the output signal DOUT may be controlled according to a representative toggle number preset based on grayscale and polarity changes with respect to the image data of the frame period. Thus, the heating of the data driver circuit according to a level change of the output signal DOUT may be reduced.

Figure 8:
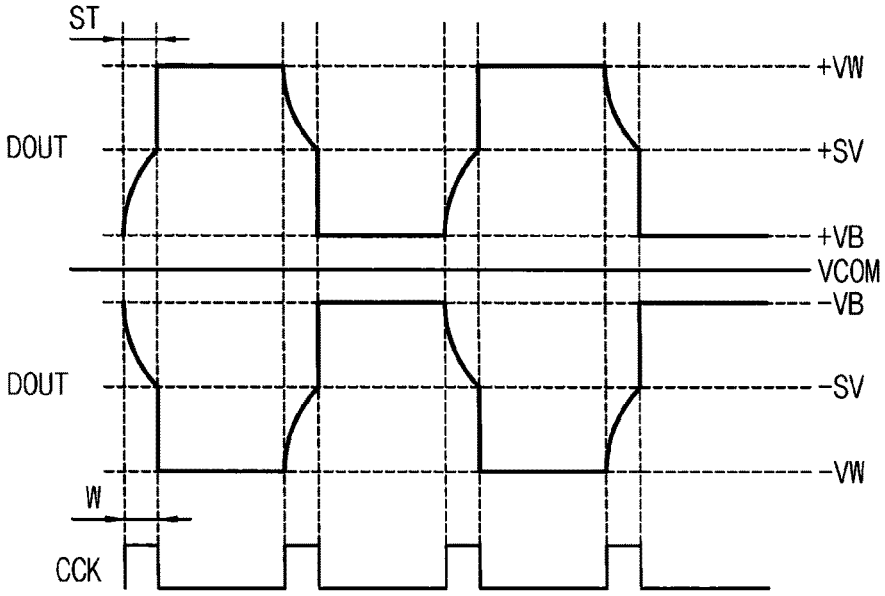
FIG. 8 is a waveform diagram illustrating a method of adjusting a charge share time of an output signal which is outputted from a data driver circuit according to an exemplary embodiment.

FIG. 8 is a waveform diagram illustrating a method of adjusting a charge share time of an output signal which is outputted from a data driver circuit according to an exemplary embodiment.

Referring to FIGS. 1 and 8, the data driver circuit is configured to receive a charge control signal being the power control signal PCS from the timing controller, and to adjust a charge share time ST of the output signal DOUT of the data driver circuit based on a level of the charge control signal.

The charge share time ST of the output signal DOUT may be controlled by a pulse width W of a control clock signal CCK. For example, the data driver circuit is configured to output a share voltage SV during an early horizontal period corresponding to a pulse width W of the control clock signal CCK, and then output a data voltage (+VW or −VW) during a remaining horizontal period.

The data driver circuit is configured to generate the control clock signal CCK having the pulse width W controlled based on the charge control signal, and to control the charge share time ST of the output signal DOUT based on the pulse width W of the control clock signal CCK.

When the level of the charge control signal has a fourth level "3" being the largest, the data driver circuit generates the control clock signal CCK having a fourth pulse width and controls the charge share time ST of the output signal DOUT corresponding to the fourth pulse width. When the level of the charge control signal has a third level "2" smaller than the fourth level "3", the data driver circuit generates the control clock signal CCK having a third pulse width smaller than the fourth pulse width and controls the charge share time ST of the output signal DOUT corresponding to the third pulse width.

Therefore, the charge share time of the output signal DOUT may be controlled according to a representative toggle number preset based on grayscale and polarity changes with respect to the image data of the frame period. Thus, the heating of the date driver circuit according to a level change of the output signal DOUT may be reduced.

Figure 9:
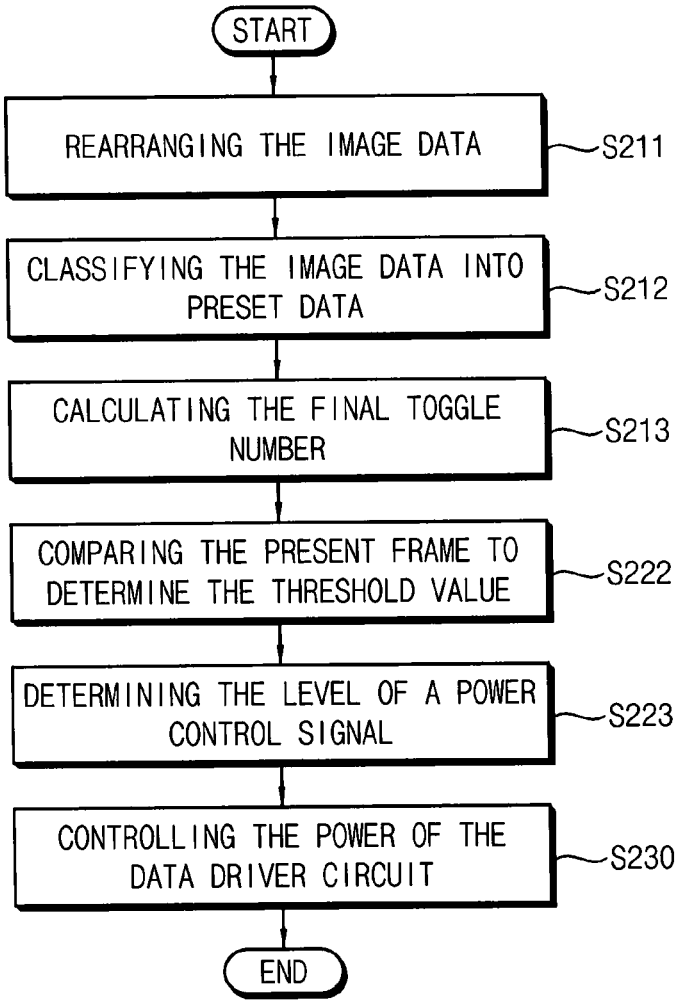
FIG. 9 is a flowchart illustrating a method of driving a display apparatus according to an exemplary embodiment.

FIG. 9 is a flowchart illustrating a method of driving a display apparatus according to an exemplary embodiment.

Referring to FIGS. 1, 2 and 9, the timing controller 210 is configured to receive image data DATA.

The mapper 212 is configured to rearrange the image data DATA according to a pixel structure of the display panel 100 (Step S211).

The classifier 213 classifies the image data DATA into the preset data of 2-bits (Step S212). The image data DATA are classified into high preset data (01), low preset data (00), or normal preset data (10) based on a high reference grayscale and a low reference. When a grayscale of the image data DATA is greater than the high reference grayscale, the image data DATA are classified into the high preset data (01). When the grayscale of the image data DATA is equal to or less than the low reference grayscale, the image data DATA are classified into the low preset data (00). When the grayscale of the image data DATA is greater than the low reference grayscale and equal to or less than the high reference grayscale, the image data DATA are classified into the normal preset data (10).

The toggle counter 214 is configured to compare the preset data of the present horizontal line and the preset data of the previous horizontal line classified from the classifier 213. The toggle counter 214 is configured to count a number of toggles in which the preset data applied to a same data line are changed from the high preset data (01) to the low preset data (00) or from the low preset data (00) to the high preset data (01). In addition, the toggle counter 214 is configured to apply a weighted value to the toggle number based on a swing width of the data voltage based on the inversion mode of the display panel 100 (Step S213). The final toggle number may be calculated respectively corresponding to the driving areas A1, A2, A3, and A4 driven by the data driver circuits.

The determiner 215 determines a representative toggle number of the present frame. The determiner 215 compares the representative toggle number of the present frame with a representative toggle number of a previous frame, determines a plurality of threshold values TH1, TH2, and TH3 based on a comparison result (Step S222). A representative toggle number of the present frame may be compared with a representative toggle of the previous frame to easily respond against a grayscale change of the image data.

Then, the determiner 215 determines a level of a power control signal PCS using the plurality of threshold values TH1, TH2, and TH3 (Step S223).

For example, when the representative toggle number of the present frame is greater than the first threshold value TH1, the determiner 215 determines the level of the power control signal into a fourth level "3" that is a maximum level. When the representative toggle number of the present frame is less than the first threshold value TH1 and greater than the second threshold value TH2, the determiner 215 determines the level of the power control signal PCS into a third level "2" that is less than the fourth level "3". When the representative toggle number of the present frame is less than the second threshold value TH2 and greater than the third threshold value TH3, the determiner 215 determines the level of the power control signal PCS into a second level "1" that is less than the third level "2". When the representative toggle number of the present frame is less than the third threshold value TH3, the determiner 215 determines the level of the power control signal PCS into a first level "0" that is less than the second level "1".

The determiner 215 is configured to provide the data driver circuits with of the power control signal PCS having the determined level. The plurality of data driver circuits is configured to output the output signal which has the power slew rate and the charge share time controlled by the power control signal PCS (Step S230).

The heating of the date driver circuit according to a level change of the output signal DOUT may be reduced.

Figure 10:
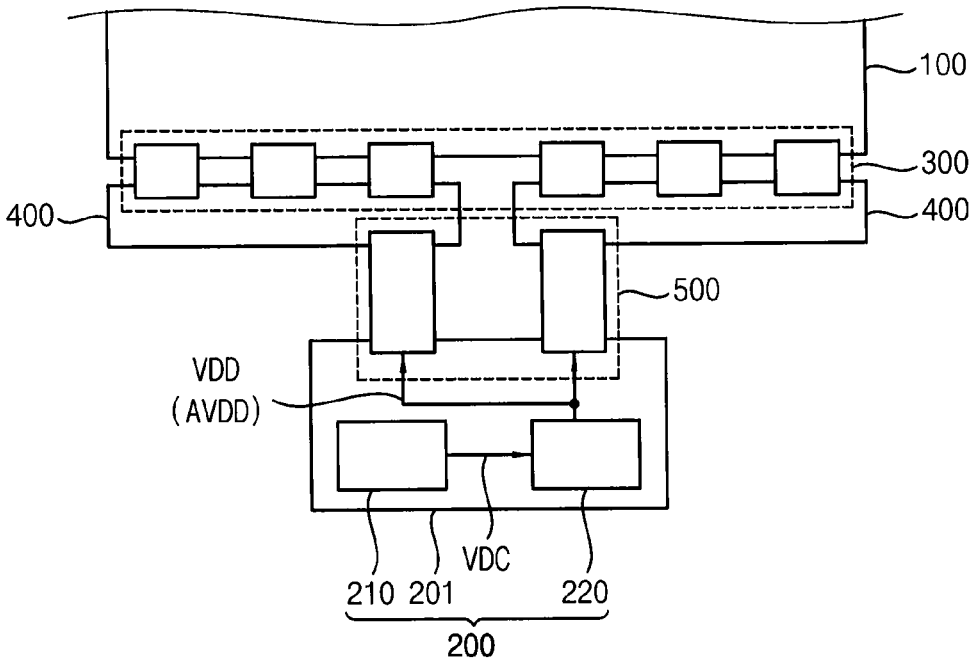
FIG. 10 is a block diagram illustrating a display apparatus according to an exemplary embodiment.

FIG. 10 is a block diagram illustrating a display apparatus according to an exemplary embodiment.

Hereinafter, the same reference numerals are used to refer to the same or like parts as those described in the previous exemplary embodiments, and the same detailed explanations are not repeated unless necessary.

Referring to FIG. 10, the display apparatus according to the exemplary embodiment may include a display panel 100, a control circuit module 200, a data driver module 300, a source circuit board 400, and a flexible circuit board 500.

The display panel 100 includes a plurality of data lines DL, a plurality of gate lines GL, and a plurality of pixels P, all of which are disposed in a display area DA.

The control circuit module 200 includes a timing controller 210 and a voltage generator 220 that are disposed on a printed circuit board 201.

The timing controller 210 includes the same or like parts as those described in the previous exemplary embodiment as shown in FIG. 2.

The voltage generator 220 is configured to generate a plurality of driving voltages using an external voltage for driving the display panel 100. The plurality of driving voltages includes a data driver voltage VDD applied to the data driver module 300, a gate driver voltage applied to the gate driver module 600 (as shown in FIG. 1), and a common voltage VCOM applied to the display panel 100. The gate driver voltage includes a gate-on voltage and a gate-off voltage to generate a gate signal applied to a gate line.

For example, referring to FIG. 2, the timing controller 210 may include a memory 211, a mapper 212, a classifier 213, a counter 214 and a determiner 215.

The memory 211 is configured to store the image data DATA. The memory 211 may be a line memory storing the image data DATA by a horizontal line period such as a line memory.

The mapper 212 is configured to rearrange the image data DATA according to a pixel structure of the display panel 100.

The classifier 213 is configured to classify the image data DATA into preset data of n bits ("n" is a natural number).

For example, the classifier 213 classifies the image data DATA into the preset data of 2-bits. The image data DATA are classified into high preset data (01), low preset data (00) or normal preset data (10) based on a high reference grayscale and a low reference. When a grayscale of the image data DATA is greater than the high reference grayscale, the image data DATA are classified into the high preset data (01). When the grayscale of the image data DATA is equal to or less than the low reference grayscale, the image data DATA are classified into the low preset data (00). When the grayscale of the image data DATA is greater than the low reference grayscale and equal to or less than the high reference grayscale, the image data DATA are classified into the normal preset data (10).

The toggle counter 214 is configured to count a number of toggles in which the preset data applied to a same data line are changed from the high preset data (01) to the low preset data (00) or from the low preset data (00) to the high preset data (01). In addition, the toggle counter 214 is configured to apply a weighted value to the toggle number based on a swing width between polarities of data voltages of the present and previous horizontal lines applied to the same data line in the inversion mode of the display panel 100.

The determiner 215 is configured to compare the representative toggle number of the present frame with the representative toggle number of the previous frame and to determine a plurality of threshold values TH1, TH2, and TH3.

According to the exemplary embodiment, the determiner 215 is configured to compare the threshold values TH1, TH2 and TH3 and the representative toggle number of the present frame and to determine the level of a voltage control signal VDC based on a compared result.

The voltage control signal VDC controls a level of the data driver voltage VDD generated from the voltage generator 220. For example, the voltage control signal VDC controls the level of an analog source voltage AVDD. The plurality of data driver circuits of the data driver module 300 are configured to generate a data voltage, which is an output signal using the analog source voltage AVDD.

According to the exemplary embodiment, when the representative toggle number of the present frame is more than the first threshold value (TH1), the determiner 215 determines the level of the voltage control signal VDC into a fourth level "3" that is most level. When the representative toggle number of the present frame is less than the first threshold value (TH1) and greater than the second threshold value (TH2), the determiner 215 determines the level of the voltage control signal VDC into a third level "2" that is less than the fourth level "3". When the representative toggle number of the present frame is less than the second threshold value (TH2) and greater than the third threshold value (TH3), the determiner 215 determines the level of the voltage control signal VDC into a second level "1" that is less than the third level "2". When the representative toggle number of the present frame is less than the third threshold value (TH3), the determiner 215 determines the level of the voltage control signal VDC into a first level "0" that is less than the second level "1".

The determiner 215 is configured to provide the voltage generator 220 with the voltage control signal VDC.

The voltage generator 220 is configured to generate the analog source voltage AVDD of the level which corresponds to the voltage control signal VDC having the determined level. For example, when the representative toggle number of the present frame increases, the level of the analog source voltage AVDD decreases. When the representative toggle number of the present frame decreases, the level of the analog source voltage AVDD approximates to a normal level of the analog source voltage AVDD.

According to the exemplary embodiment, the level of the analog source voltage AVDD may be controlled according to a representative toggle number preset based on grayscale and polarity changes with respect to the image data of the frame period and thus, the heating of the date driver circuit according to a level change of the output signal DOUT may be reduced.

Although not shown in figures, the level of the analog source voltage AVDD simultaneously with the power slew rate and the charge share time of the output signal DOUT may be controlled according to a representative toggle number preset based on grayscale and polarity changes with respect to the image data of the frame period.

As described above, according to exemplary embodiments, the power slew rate and the charge share time of the output signal may be controlled according to a representative toggle number preset based on grayscale and polarity changes with respect to the image data of the frame period. Thus, the heating of the date driver circuit according to a level change of the output signal may be reduced. In addition, the level of the analog source voltage may be controlled according to a representative toggle number preset based on grayscale and polarity changes with respect to the image data of the frame period. Thus, the heating of the date driver circuit according to a level change of the output signal may be reduced.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A display apparatus comprising:

a display panel comprising a data line and a gate line crossing the data line;

a classifier configured to classify image data into preset data of an n-bits ("n" is a natural number);

a toggle counter configured to a number of toggles ("toggle number") based on preset data of a present horizontal line and a previous horizontal line, and to calculate a final toggle number using weighted values corresponding to a swing width between data voltages of the present horizontal line and the previous horizontal line;

a determiner configured to determine a representative toggle number of a present frame based on a plurality of final toggle numbers of the present frame, compare the representative toggle number with a plurality of threshold values, and determine a level of a power control signal based on a compared result; and a data driver circuit configured to drive the data line, and control a power of an output signal based on the determined level of the power control signal.

2. The display apparatus of claim 1, wherein the classifier is configured to compare the image data with a high reference grayscale and a low reference grayscale, and to classify the image data into high preset data, low preset data, and normal preset data.

3. The display apparatus of claim 2, wherein the toggle counter is configured to count the number of toggles in which the preset data of the present horizontal line and the previous horizontal line are changed from the high preset data to the low preset data, or from the low preset data to the high preset data.

4. The display apparatus of claim 2, wherein:

the weighted values comprise a first weighted value corresponding to a first swing width between a white voltage and a black voltage having a same polarity, a second weighted value corresponding to a second swing width between white voltages having a difference polarity from each other, and a third weighted value corresponding to a third swing width between black voltages having a difference polarity from each other; and the first weighted value is less than the second weighted value and the third weighted value is less than the first weighted value.

5. The display apparatus of claim 4, wherein the first weighted value corresponds to a swing width between the white voltage and the black voltage having a difference in polarity from each other.

6. The display apparatus of claim 1, wherein:

the display panel is divided into a plurality of driving areas driven by a plurality of driver circuits; and the toggle counter is configured to calculate the plurality of final toggle numbers respectively corresponding to the plurality of driving areas.

7. The display apparatus of claim 6, wherein the determiner is configured to determine a maximum value of the plurality of final toggle numbers corresponding to the plurality of driving areas into the representative toggle number of the present frame.

8. The display apparatus of claim 6, wherein the determiner is configured to determine a sum value of the plurality of final toggle numbers corresponding to the plurality of driving areas into the representative toggle number of the present frame.

9. The display apparatus of claim 6, wherein the determiner is configured to compare the representative toggle number of the present frame with the representative toggle number of the previous frame and to determine the plurality of threshold values.

10. The display apparatus of claim 6, wherein the power control signal is configured to control a power slew rate and a charge share time of the output signal outputted from the data driver circuit.

11. The display apparatus of claim 1, further comprising a voltage generator configured to generate an analog source voltage for driving the data driver circuit, wherein:

the determiner is configured to compare the representative toggle number of the present frame with a plurality of threshold values and to determine a level of a voltage control signal; and the voltage generator is configured to control the level of the analog source voltage based on the level of the voltage control signal.

12. The display apparatus of claim 1, further comprising a mapper configured to rearrange the image data according to a pixel structure of the display panel.

13. A method of driving a display apparatus comprising:

classifying image data into preset data of an n-bits ("n" is a natural number);

counting a number of toggles ("toggle number") based on preset data of a present horizontal line and a previous horizontal line;

calculating a final toggle number using a weighted value corresponding to a swing width between data voltages of the present horizontal line and previous horizontal line;

determining a level of a power control signal comparing the representative toggle number of a present frame with a plurality of threshold values; and controlling a power of an output signal of a data driver circuit configured to drive a data line of a display panel based on the determined level of the power control signal.

14. The method of claim 13, wherein the classifying the image data comprising:

comparing the image data with a high reference grayscale and a low reference grayscale; and classifying the image data into high preset data, low preset data, and normal preset data based on a compared result.

15. The method of claim 13, wherein the toggle counter is configured to count the number of toggles in which the preset data of the present horizontal line and the previous horizontal line are changed from the high preset data to the low preset data or from the low preset data to the high preset data.

16. The method of claim 13, wherein:

the weighted values comprises a first weighted value corresponding to a first swing width between a white voltage and a black voltage having a same polarity, a second weighted value corresponding to a second swing width between white voltages having a difference polarity from each other, and a third weighted value corresponding to a third swing width between black voltages having a difference polarity from each other; and the first weighted value is less than the second weighted value and the third weighted value is less than the first weighted value.

17. The method of claim 13, wherein:

the display panel is divided into a plurality of driving areas driven by a plurality of driver circuits;

the plurality of final toggle numbers is calculated respectively corresponding to the plurality of driving areas; and the representative toggle number of the present frame is determined using the plurality of final toggle numbers.

18. The method of claim 17, further comprises:

comparing the representative toggle number of the present frame with the representative toggle number of the previous frame to determine the plurality of threshold values.

19. The method of claim 13, wherein the power control signal is configured to control a power slew rate and a charge share time of the output signal outputted from the data driver circuit.

20. The method of claim 13, further comprising;

comparing the representative toggle number of the present frame with a plurality of threshold values to determine a level of a voltage control signal; and controlling the level of the analog source voltage applied to the data driver circuit based on the level of the voltage control signal.

* * * * *